US011447384B2

(12) United States Patent
Lindberg

(10) Patent No.: US 11,447,384 B2
(45) Date of Patent: Sep. 20, 2022

(54) ELECTRONIC BEVERAGE DOSING AND POURING SPOUT

(71) Applicant: PROVARGO A/S, Greve (DK)

(72) Inventor: Peter Lindberg, Greve (DK)

(73) Assignee: PRO VARGO A/S, Greve (DK)

( * ) Notice: Subject to any disclaimer, the term of this patent is extended or adjusted under 35 U.S.C. 154(b) by 0 days.

(21) Appl. No.: 17/279,342

(22) PCT Filed: Oct. 3, 2019

(86) PCT No.: PCT/EP2019/076806
§ 371 (c)(1),
(2) Date: Mar. 24, 2021

(87) PCT Pub. No.: WO2020/070241
PCT Pub. Date: Apr. 9, 2020

(65) Prior Publication Data

US 2021/0403310 A1 Dec. 30, 2021

(30) Foreign Application Priority Data

Oct. 4, 2018 (EP) ..... 18198554

(51) Int. Cl.
*B67D 3/00* (2006.01)

(52) U.S. Cl.
CPC ..... *B67D 3/0041* (2013.01); *B67D 3/0051* (2013.01); *B67D 3/0003* (2013.01); *B67D 2210/00089* (2013.01)

(58) Field of Classification Search
CPC .. B67D 3/0041; B67D 3/0051; B67D 3/0003; B67D 2210/00089
See application file for complete search history.

(56) References Cited

U.S. PATENT DOCUMENTS 2,554,570 A * 5/1951 Harvey ..... G01F 11/08 222/207
3,920,149 A * 11/1975 Fortino ..... G06Q 20/342 222/1

(Continued)

FOREIGN PATENT DOCUMENTS

AU 545 688 B2 7/1985
EP 1 227 058 A1 7/2002

(Continued)

OTHER PUBLICATIONS

International Search Report for International Application No. PCT/EP2019/076806 dated Dec. 10, 2019.

*Primary Examiner* — Frederick C Nicolas
(74) *Attorney, Agent, or Firm* — Merchant & Gould P.C.

(57) ABSTRACT

Electronic pouring device (10) for dosing a pre-determined amount of liquid from a liquid container, the electronic pouring device including a housing (11), the housing including: an inlet opening (17) and an outlet opening (19) for the passage of liquid from the liquid container, a valve including a valve member (22) for controlling the passage of the liquid and a valve seat (20) at the outlet opening (19) for arresting the valve in a closed position, a liquid internal region (28) for accommodating the valve and for allowing the passage of the liquid through the housing (11), a dry internal region (30) for accommodating displacement structure for displacing the valve against the valve seat (20) into the closed position, or for displacing the valve away from the valve seat (20) into an opened position, the displacement structure including drive structure (25) and transmission structure (24), and a membrane (29) for separating the dry internal region (30) from the liquid internal region (28).

14 Claims, 6 Drawing Sheets

(56) References Cited

U.S. PATENT DOCUMENTS

| | | | | |
|---|---|---|---|---|
| 4,265,370 | A * | 5/1981 | Reilly | G01F 11/00 222/211 |
| 6,036,055 | A | 3/2000 | Mogadam et al. | |
| 8,925,769 | B2 * | 1/2015 | Zapp | B67D 3/0006 222/567 |
| 9,022,257 | B2 * | 5/2015 | Keating | B67D 3/0041 222/207 |
| 9,212,041 | B2 * | 12/2015 | Keating | B67D 3/0051 |
| 2006/0027268 | A1 | 2/2006 | Zapp | |
| 2009/0230157 | A1 * | 9/2009 | Lindberg | B67D 3/0003 222/504 |
| 2014/0263429 | A1 | 9/2014 | Keating et al. | |

FOREIGN PATENT DOCUMENTS

| | | |
|---|---|---|
| WO | 94/15872 | 7/1994 |
| WO | 2007/014402 A1 | 2/2007 |

* cited by examiner

A—A

ELECTRONIC BEVERAGE DOSING AND POURING SPOUT

This application is a National Stage Application of PCT/EP2019/076806, filed 3 Oct. 2019, which claims benefit of Ser. No. 18/198,554.0, filed 4 Oct. 2018 in Europe, and which applications are incorporated herein by reference. To the extent appropriate, a claim of priority is made to each of the above disclosed applications.

The present invention relates to an electronic pouring device for the dosage of precise measures of beverage from liquid containers, in particular bottles containing beverages having high alcohol content such as liquor and wine.

BACKGROUND

Pouring devices are used for the dispensing of precise amounts of such liquids. In drinking establishments such as pubs, clubs and bars, as well as private houses, pouring devices are normally utilized in connection with the pouring of alcoholic liquids, i.e. alcoholic beverages, in particular beverages having a relatively high alcohol content, i.e. above 10 wt %, such as liquors and wine. For liquors having a particularly high alcohol content of 30 wt % or more, like rum, gin, vodka or similar, precise amounts of e.g. 20 or 25 mL need to be poured from the respective bottle into a beverage glass. The pouring should not only be accurate and consistent, thus reliable, yet also quick. Also for management control, given the high price of such liquors, the amount poured has to stay consistently and accurately at the predetermined dosage of 20, 25, or 30 ml or any other preferred size. In addition, the user or operator, e.g. a bartender, is normally under a huge amount of pressure to provide drinks or cocktails to the customers as quickly and consistently as possible. The bartender should also be able to immediately change the dosage or pouring amount of a specific liquor, e.g. from 20 mL to 30 mL as required by a customer, particularly in connection with rush hours such as happy hours, sport events, concerts, etc. Moreover, drinking establishments loose a significant amount of income due to pilferage by the operators, e.g. bartenders keeping the payment for them self or pouring more liquor or wine than necessary to friends. Pouring accuracy and control is therefore also crucial to mitigate this problem.

It would therefore be desirable that a pouring device is able to control every pouring and bottle shift at the points of sales in the drinking establishment.

It would also be desirable that the pouring device, apart from being able to provide the above-mentioned consistency, accuracy, speed and control when pouring liquors, is also so user-friendly and so versatile that it can also be used for pouring beverages other than liquor. In particular, the pouring device should also be suitable for beverages having a lower alcohol content and where the amounts poured are normally larger than those for liquors, more specifically for the pouring of wine. This beverage, having an alcohol content of about 14 wt % and thus significantly lower than the alcohol content of the above liquors, enables the operator, e.g. a bartender or a private person to pour a much higher amount in a glass, typically 120 mL-200 mL or even more.

Apart from the above needs of consistency, accuracy, speed, control, adaptability and user-friendliness e.g. by the pouring device also being light and non-bulky, the pouring device should be easy to clean and at least provide indications to the user or operator that the pouring device requires cleaning so as to quickly enabling the user to switch to an already clean or unused pouring device.

Cleaning is a relevant problem in pouring devices, as these normally include a combination of mechanical and electrical elements, thus making cleaning inherently difficult. In particular, electrical elements may not be in contact with water and thus the pouring devices are not immediately suitable for cleaning by hand or by including them in the utensils normally put in a dishwashing machine. Cleaning of pouring devices at regular intervals is also required as the result of the pouring of liquors having a high content of sugar, which increases the risk of crystal deposits attaching to internal surfaces of the pouring device, not least outlet gaskets, which then impair the regular opening and closing mechanism of a valve disposed therein.

All the above requirements present formidable technical challenges in the provision of technologies behind pouring devices, in particular electronic pouring devices.

Typically, pouring devices provide the dosing of liquid by the incorporating a valve which opens by the use of electromagnetic means. An electromagnet or electromagnetic forces actuate the valve against the force of a spring, and thus high power consumption is required. It is also limited how much the valve can be opened using electromagnetic forces, which again makes the amount poured less precise over time. Furthermore, such devices tend to be heavy and bulky, which reduce their user-friendliness and thus the applicability in drinking establishments.

U.S. Pat. No. 6,036,055 discloses an electronic spout according to the electromagnetic principle, i.e. in which an electromagnetic force actuates the valve against the force of a spring.

WO 2007/14402 A1 discloses a pouring device where the inlet gasket of the pouring device is opened or closed by a magnetisable rod or plate which is spring based.

WO 94/15872 A2 discloses a liquid dispensing device comprising a slide valve, which is actuated by means of an offset finger driven by a geared motor. This solution is not based on the ability to carry the bottles. The device instead of being mobile is intended for affixing to a wall with a solid power supply from a plug.

This citation is at least silent about the liquid dispenser being provided with separated liquid and dry chambers, a membrane for effectively having this separation of the chambers, and a device for measuring the flow of liquid passing through.

US 2006/0027268 A1 discloses a dosing device comprising an electric motor which actuates the main valve directly. This main valve is provided at one end with a valve magnet, while an activator comprising a permanent motor magnet is displaced by the motor to cooperate with the valve magnet and thus open and close the main valve. It is also mentioned that the motor could act directly on the main valve by means of a rod extending from the main valve, thus eliminating the need of using a spring. Yet, this citation is silent at least about the pouring device being provided with separated liquid and dry chambers, a membrane for effectively having this separation of the chambers, and a device for measuring the flow of liquid passing through.

SUMMARY OF THE DISCLOSURE

It is an object of the present invention to provide a pouring device for the dosage of liquid from liquid containers such as bottles containing liquor or wine, which is accurate and consistent, hence reliable, user-friendly, and with a good cleaning functionality.

It is another object of the present invention to provide a pouring device for the dosage of liquid from liquid containers such as bottles containing liquor or wine, which is able to pour a wide variety of amounts of liquid, ranging from small amounts such as 20-30 mL for liquors to 140 mL or more.

It is yet another object of the present invention to provide a pouring device for dosage by hand, i.e. manually, of liquid from liquid containers such as bottles containing liquor or wine, which allows the user to carry the bottles freely and gives full control of the pouring and bottle change.

These and other objects are solved by the present invention by the provision of an electronic pouring device for dosing a pre-determined amount of liquid from a liquid container, said electronic pouring device comprising a housing, said housing comprising:

- an inlet opening and an outlet opening for the passage of liquid from said liquid container,
- a valve for controlling the passage of said liquid,
- a valve seat at said outlet opening for arresting said valve in a closed position,
- a liquid internal region for accommodating said valve and for allowing the passage of said liquid through said housing,
- a dry internal region for accommodating displacement means for displacing said valve against said valve seat into said closed position, or for displacing said valve away from said valve seat into an opened position, said displacement means comprising drive means and transmission means,
- a membrane for separating said dry internal region from said liquid internal region.

By the term "a valve for controlling the passage of said liquid" is meant "a valve comprising a valve member for controlling the passage of said liquid". Hereinafter, the latter is used.

By the term "a valve seat at said outlet opening for arresting said valve in a closed position" is meant "a valve seat at said outlet opening for arresting said valve member in a closed position". Hereinafter, the latter is used.

By the term "a liquid internal region for accommodating said valve and for allowing the passage of said liquid through said housing" is meant "a liquid internal region for accommodating said valve member and for allowing the passage of said liquid through said housing". Hereinafter, the latter is used.

By the term "a dry internal region for accommodating displacement means for displacing said valve against said valve seat into said closed position, or for displacing said valve away from said valve seat into an opened position, said displacement means comprising drive means and transmission means" is meant "a dry internal region for accommodating displacement means for displacing said valve member against said valve seat into said closed position, or for displacing said valve member away from said valve seat into an opened position, said displacement means comprising drive means and transmission means". Hereinafter, the latter is used.

Accordingly, by the present invention there is provided an electronic pouring device for dosing a pre-determined amount of liquid from a liquid container, said electronic pouring device comprising a housing, said housing comprising:

- an inlet opening and an outlet opening for the passage of liquid from said liquid container,
- a valve comprising a valve member for controlling the passage of said liquid and a valve seat at said outlet opening for arresting said valve member in a closed position,
- a liquid internal region for accommodating said valve member and for allowing the passage of said liquid through said housing,
- a dry internal region for accommodating displacement means for displacing said valve member against said valve seat into said closed position, or for displacing said valve member away from said valve seat into an opened position, said displacement means comprising drive means and transmission means,
- a membrane for separating said dry internal region from said liquid internal region.

As used herein, the term "pre-determined amount of liquid" means the dosage that is set to be poured by the electronic device, e.g. 20, 25, 30 mL, or 140 mL, as required by the consumer.

As used herein, the term "liquid" means beverage, in particular an alcoholic beverage having an alcohol content higher than 10 wt % such as a liquor and wine.

Hence, the pouring device is electronic, i.e. it contains electronic elements, and liquid from the liquid container, i.e. bottle, e.g. liquor bottle or wine bottle, passes through in a controlled, quick, accurate and consistent manner into a glass, cocktail shaker or other recipient. The valve member is displaced by the displacement means including drive means and transmission means located in a dry internal region of the housing, which then drives the displacement of the valve member in the liquid internal region, thereby enabling a fast, precise opening and closing of the valve in a compact and user-friendly structure. In other words, the valve member is driven from the dry internal region, but moves in the liquid internal region.

In prior art pouring devices, requiring the provision of a magnet in the valve mechanism, the magnetic force providing the displacement via said magnet, results in a less powerful opening and therefore a smaller valve opening, and further due to this a less stable pouring accuracy over time compared to the valve displacement of the present invention.

In addition, contrary to the prior art, a larger, more powerful, more regular and quicker opening of the valve and thereby the electronic pouring device is possible, thus generating a better pouring, i.e. a pouring which is at least more accurate and consistent with respect to the prior art.

None of the prior art discloses the combination of features of the present invention.

In an embodiment, said valve comprises a valve outlet gasket, a valve body and valve rod, said valve body adapted to cooperate with said outlet gasket, said valve rod adapted to cooperate with said valve body, and wherein said displacement means for displacing said valve actuates on said valve rod, said valve rod thereby displacing said valve body and said valve outlet gasket, thereby also displacing said valve into said opened or closed position.

By the term "valve body" is meant "valve member". Hereinafter, the latter is used.

Hence, according to this embodiment, said valve further comprises a valve outlet gasket and a valve rod, said valve member adapted to cooperate with said outlet gasket, said valve rod adapted to cooperate with said valve member, and wherein said displacement means for displacing said valve member actuates on said valve rod, said valve rod thereby displacing said valve member and said valve outlet gasket, thereby also displacing said valve member into said opened or closed position.

The displacement of the valve rod is conducted along the length direction of the electronic pouring device. It is assumed that the electronic device is in an upright position when it is standing on a horizontal surface, as illustrated in FIG. 1-4 and thus the length direction runs vertically in the figures. Hence, by the term "upper end" of a given element, it is meant the end that is closest to the outlet opening of the housing and thereby also closest to the outlet orifice of the electronic pouring device. By "lower end" of a given element, is meant the end opposite to said "upper end" of the element along the length direction of the electronic pouring device, and which correspondingly is closest to inlet opening of the housing. Accordingly, the valve rod defines an upper end being connected to said valve member via said membrane, in particular by said valve rod being in contact with said membrane, more particularly by being in contact with an inner ring of said membrane. The valve rod defines also a lower end being connected to said transmission means. The lower end of the valve rod includes preferably a protrusion extending perpendicularly to the length direction of the valve rod and in a direction pointing towards the transmission means. In a particular embodiment, the lower end of the valve rod includes a nut. Said nut is preferably integrated into the valve rod, and more preferably into said protrusion for securing the engagement with the transmission means. The nut may then be in direct contact with the transmission means. The nut may not be integrated but simply affixed to the valve rod.

The valve member, in turn, defines an upper end being in contact with said valve outlet gasket and a lower end being connected to said valve rod. The drive means actuates the transmission means, which then actuates on the lower end of the valve rod, thus providing its displacement along the length direction of the electronic pouring device and thereby enabling the opening and closing of the valve in a consistent manner, i.e. with the same force at all times. This is a significant improvement with respect to pouring devices based on the electromagnetic mechanism whereby as the power is reduced, the greater the opening of the valve becomes, thus impairing consistency.

In an embodiment, said membrane cooperates with said valve rod, whereby said valve rod actuates on said membrane by moving the membrane as the valve rod displaces said valve member into said closed position or said opened position.

The membrane, which is tight and thus not permeable to the passage of liquid, enables the separation within the housing of the electronic pouring device of the liquid internal region (i.e. in direct contact with liquid), from dry internal regions where electronic elements including sensors, are located. Preferably, the membrane is flexible. Thereby, more flexibility in the construction and operation of the pouring device is possible, since the membrane moves along with the valve rod, thus avoiding the use of rigid plates, such as steel plates. The membrane is adapted so that there will be no resistance to the movement of the valve rod, e.g. by using a membrane which is slightly oversized, i.e. extra-large, as it will be defined below. This enables also that the membrane may absorb forces and adapt so that the dry internal region which is liquid and air tight, constantly has the same volume. If this is not the case, there will be resistance to the movement of the valve member and thereby the valve. In other words, said membrane, apart from flexible, may be thin yet large enough so that the drive means does not experience any resistance from the membrane. The membrane acts therefore like a plastic bag. The membrane is larger than it is required for it to move as the valve rod displaces the valve member into the closed or open position, e.g. if the membrane only needs to move 5-10 mm along the length direction of the electronic pouring device to enable the displacement of the valve member into the closed or opened position corresponding to that distance (5-10 mm), i.e. the distance travelled by the valve membrane, the membrane is oversized, preferably slightly oversized by allowing a movement of the membrane of say 10-20 mm along said length direction. Accordingly, in a particular embodiment, said membrane is at least 10% larger, preferably at least 30% larger, more preferably at least 50% larger, than is necessary to accommodate the distance travelled by the displacement of said valve member from said closed position into said opened position, or the distance travelled by the displacement of said valve member from said opened position into said closed position. Preferably also, the upper limit is 100 or 200% larger. That is, the membrane is 10-100%, or 10-200%, or 30-100%, or 30-200%, or 50-100%, or 50-200% larger than the distance travelled by the displacement of said valve member from said closed position into said opened position, or the distance travelled by the displacement of said valve member from said opened position into said closed position.

In a particular embodiment, said membrane includes an outer ring, which is liquid-tight and disposed between said dry internal region and said liquid internal region, and an inner ring, which is liquid-tight and attached to said valve member and said valve rod, whereby said moving of said membrane is conducted by said valve rod moving said inner ring, as said valve rod displaces said valve member into said closed position and said opened position.

In an embodiment, the drive means includes at least one motor, preferably an electric motor, and the transmission means includes at least one threaded rod. Hence, the drive means includes a motor, while the transmission means includes a threaded rod.

In a particular embodiment, the transmission means also includes a set of gears comprising a first and a second set of gears, where said threaded rod is connected to said second set of gears, while the motor engages with said first set of gears, and said first set of gears engages with said second set of gears and thereby said threaded rod.

The first set of gears is preferably in the form of a first small gear, e.g. having nine teeth, placed at the motor and in direct contact thereto. The second set of gears is preferably in the form of a second bigger gear, e.g. having thirty-six teeth, for adjusting the speed of movement of the valve member connected to the threaded rod.

As used herein, the term "set of gears" means one or more gears.

In particular, the combination of an electric motor and a threaded rod which cooperates with a valve rod including a nut, has shown the best results in terms of speed, size and dispensing consistency during the opening and closing of the valve. As already described above, preferably the lower end of the valve rod includes said nut. The nut is also preferably integrated into the valve rod, and more preferably into said protrusion at the lower end of the valve rod, thereby securing the engagement with the threaded rod. The use of a threaded rod which actuates the valve rod having a nut, enables a much less bulky solution than for example a rack-pinion solution, in addition to providing a more powerful opening. The drive means is integral within the housing, i.e. it is fixed therein. A battery is also provided within the housing, e.g. within the dry internal region for supplying the electric motor.

In an embodiment, said dry internal region includes a set of sensors, e.g. two or more sensors, for identification of the exact position of said valve member or said valve rod during its displacement. Such exact position is measured along the length direction of the electronic pouring device by providing sensors, which suitably are highly sensitive sensors. In one particular embodiment, said set of sensors is a set of optical sensors. In another particular embodiment, said set of sensors is a set of optical sensors, said valve rod is provided with a protrusion at its lower end extending perpendicularly to the length direction of the valve rod, and said set of optical sensors are adapted to cooperate with said protrusion for controlling the displacement of said valve member into said opened or closed position. As the protrusion of the valve rod passes in between the transmitting part and the receiving part of the set of optical sensors, the light beam generated in between the optical sensor parts is interrupted and thus, the displacement of the valve rod and thereby the valve member is registered, so that its opening and closing (thus also the valve opening and closing) is precisely controlled. In another particular embodiment, said set of sensors are hall-effect-sensors. In yet another embodiment, said valve rod includes one or more magnets and said set of sensors are hall-effect-sensors.

In an alternative embodiment, said dry internal region includes a mechanical stopping mechanism, i.e. not electronically based, and the mechanical stopping mechanism is provided on said transmission means for identification of the exact position of said valve member or said valve rod during its displacement, wherein the transmission means includes a third and fourth set of gears, wherein a second and preferably smaller gear, e.g. having nine teeth, of said second set of gears is adapted on top of said first gear, e.g. having thirty-six teeth, of said second set of gears, wherein said second and smaller gear of the second set of gears drives a third set of gears by engaging with a first and preferably larger gear, e.g. having thirty-six teeth of said third set of gears, wherein a second and preferably smaller gear, e.g. having nine teeth, of said third set of gears is adapted on top of said first gear, e.g. having thirty-six teeth, of said third set of gears, wherein said second and smaller gear of said third set of gears drives a fourth set of gears by engaging with a first and preferably larger gear, e.g. having thirty-six teeth, of said fourth set of gears, and wherein said first gear of said fourth set of gears is provided on its top with a stop block, and preferably said set fourth set of gears comprises only said first gear, and wherein said housing is provided with a stopping element seated or affixed thereto, which is adapted to cooperate with said stop block.

Hence, when the threaded rod has made the required turns or rotations, e.g. fourteen turns, for opening the valve the optimum distance, e.g. 5 mm, thus ensuring a stable and fast flow of liquid, the stop block on the fourth gear will hit a stopping element seated on the housing. When closing the valve, the set of gears above will allow the threaded rod to make e.g. 14 turns and said valve to move 5 mm into exact closing position, before said stop block on said fourth gear hits the other end at the stopping element seated in the housing.

In an embodiment, said valve outlet gasket has a rounded shape, preferably in the form of a ball, which is adapted to tightly seal said outlet opening at said valve seat. The valve outlet gasket is or acts as plug or stop cock and is preferably made of a hard plastic.

By "tightly seal" is meant that the valve enables the electronic pouring device to act as a cork, thus avoiding the escape of liquid from the liquid container.

As mentioned above, conventional pouring devices require the provision of a magnet in the valve. It is often found that the magnetic force providing the displacement via said magnet results in an abrupt and less regular opening and closing of the valve. Furthermore, this problem combined with the presence of sugar in a liquid, results in sticky internal surfaces of the electronic pouring device being in contact with the liquid, thus the valve member tends to get arrested at the valve seat in such a manner that it is difficult to pull it back away from the valve seat and when pulled back, the movement away from the valve seat is too sudden or abrupt. This is undesirable as it causes undesired fluctuations in the flow of liquid in and out of the pouring device. The use of a round outlet gasket, in particular a ball valve, enables that the valve is not "stuck" into the valve seat thus reducing flow fluctuations and thereby a more constant, consistent and accurate liquid flow, which translates into a better pouring.

In an embodiment, said housing further comprises a device for measuring the flow of said liquid, i.e. a liquid flowmeter. In a particular embodiment, said device for measuring the flow of liquid includes a mill wheel encapsulated by a casing, said casing having a surface facing said dry liquid internal region, said surface being adapted to cooperate with a sensor for detecting the rotation of said mill wheel as the liquid passes through, said mill wheel including one or more internal arms, said mill wheel defining a centre, said one or more internal arms extending radially from said centre, and said one or more internal arms being provided, preferably at either end, with a magnet adapted to cooperate with said sensor. This enables the measurement of the flow of liquid through the pouring device by means of a number of pulses within a given time interval, and thus in a more accurate and consistent manner compared to flow measurements based exclusively on time. The mill wheel is provided within said liquid internal region and said sensor (for detecting the rotation of the mill wheel) is provided within said dry internal region. Suitably, said sensor is affixed to said surface of the casing facing said dry liquid internal region. Preferably, all internal arms (i.e. rotating internal arms) are provided with a magnet adapted to cooperate with said sensor. In a particular embodiment, the number of said rotating internal arms is 4-8, preferably 6, and said sensor is preferably a hall-effect-sensor. By having 4-8, preferably 6 rotating internal arms in the mill wheel, each arm provided with a magnet, i.e. 6 magnets, not only a highly precise and accurate measurement of the flow is possible, but also it is possible to register even a small amount of liquid passing through the pouring device. The sensor detects the passage of each magnet and thereby enables the measurement of the flow of liquid. The mill wheel with magnets for measuring the flow of liquid is in direct contact with the liquid itself, i.e. located inside said liquid internal region. The hall-effect-sensor is provided in the dry internal region close to where the magnets pass by when the mill wheel is rotating. Hence, the hall-effect-sensor is able to count the pulses from outside the area of the liquid internal region where the mill wheel is provided.

In an embodiment, said housing further comprises an inclination detector for registering the inclination of said electronic pouring device with respect to a vertical axis, said vertical axis being an axis extending along the direction of the gravity force. The inclination detector is preferably included on a printed circuit board (PCB) as described farther below. The inclination detector may be an accelerometer or gyroscope. The registration by the inclination detector of the pouring (i.e. dispensing) angle in comparison with the pouring time gives a calculation of the poured amount of liquid.

In a particular embodiment, said device for measuring the flow of liquid and said inclination detector are adapted to cooperate with each other for determining when the pouring of said liquid is initiated, by activating said drive means, e.g. electrical motor, and thereby displacing said valve member into said opened position.

This enables the pouring of liquid where the device for liquid flow measurement operates at its optimum. For instance, where the electronic pouring device is in an undesired position for the pouring, such as an inclination angle 90° from the vertical axis (hence, the bottle is also oriented with an inclination angle 90° from the vertical axis), the pouring device is not opened, i.e. the valve member and thus the valve of the electronic pouring device is arrested in a closed position. The inclination angles suitable for opening are adapted so that they are paired with corresponding suitable liquid flow rates. Thus, for a given inclination angle there is a corresponding suitable liquid flow rate; if the inclination is 90° from the vertical axis, as mentioned above, the corresponding liquid flow rate is low, therefore there is no opening of the pouring device. When the electronic pouring device is turned at a suitable pouring (inclination) angle where the flow is stable, e.g. 30°, the valve will open if other prerequisites are present for pouring. A built-in control system contains information on the pouring angle of the bottle mentioned above and corresponding suitable liquid flow rate or speed, which then is automatically translated into required pouring time for a certain amount of liquid.

During operation, the user inserts the electronic pouring device into the bottle neck, thereby activating the bottle change detector. The bottle is rotated at a given pouring angle as described above, thereby activating the inclination detector, e.g. an accelerometer, which then activates the opening of the valve thereby allowing the pouring of liquid, if the built-in liquid detectors detect that there is liquid in the electronic pouring device.

Preferably, said device for measuring the flow of liquid and said inclination detector are also adapted to cooperate with each other for determining whether the dispensing time is appropriate, e.g. not more than two seconds, or whether the electronic pouring device must be cleaned.

In an embodiment, said electronic pouring device further comprises within said dry internal region, a printed circuit board (PCB) containing electronic components including communication means for wireless communication with an external transmitter. In a particular embodiment, said electronic components include an internal transmitter, a microprocessor and at least said inclination detector. A dedicated battery is also provided for generating power for the electronic components therein. Activities from the valve and sensors are controlled by and collected in the microprocessor, and through an internal transmitter, data are transmitted wirelessly to a receiver connected to a computer. The computer may be connected to the Internet, in particular to a communications network, e.g. a cloud.

Said electronic pouring device may also comprise a liquid detector for registering the presence of liquid, including the flow of liquid, in said liquid internal region, i.e. liquid chamber.

In an embodiment, said electronic pouring device further comprises a visual display adapted on the exterior surface of said housing for at least indicating said liquid brand or type e.g. vodka or gin etc. and/or said pre-determined amount of liquid, i.e. the precise amount of liquid being dispensed, such as 20, 25, 30 ml or other. The visual display may be in the form of a screen. In a particular embodiment, said visual display is an E-paper display, wherein the E-paper only consumes electricity when text is changed in said display. Hence, it is possible to keep a text in the display, say vodka or gin, for many days without using the battery. The visual display may additionally indicate any information about the function of said electronic pouring device, for instance a cleaning warning, as it will be explained below, and/or battery level. When the electronic pouring device is running low on battery, the visual display provides information thereof. This ensures that the user, e.g. bartender, is not caught in a situation where the electronic pouring device suddenly stops functioning, and which is a feature normally absent in conventional pouring devices.

Optionally, buttons or digital buttons on the visual display, e.g. screen, or near the screen are also provided on said exterior surface. Since the electronic pouring device can be programmed to provide a precise amount of a given liquid, e.g. 20, 25, 30 ml or other of a liquor, or 120 ml or more of a wine, increased user-friendliness is achieved. The type of liquid to be poured as well as the required dosage is visible from the exterior surface and the user quickly can change the dosage from e.g. 20 to 30 ml for a liquor, or e.g. 120 to 140 ml for a wine.

In a particular embodiment, the electronic pouring device is cloud based. This enables information related to the electronic pouring device being registered and monitored at the display, in particular if the dispense sizes are changed, e.g. 30 ml to 35 ml or the product is changed e.g. from vodka to gin. Also if the firmware of the microprocessor detects that the electronic pouring device needs to be cleaned, this due to slow dispensing, e.g. a pouring taking three or more seconds instead of two seconds or less, an electronic cleaning warning on the display may be transmitted, thus assisting the user, e.g. bartender, in the operation of the electronic pouring device. For instance, due to i.a. the feature of the electronic pouring device being able to provide the measurement of liquid flow in the liquid itself, the cleaning of the electronic pouring device is easy to anticipate. For instance, a liquor for which the electronic pouring device is set to regularly create a flow corresponding to 50 pulses in a pouring interval of 2 seconds, a sudden decrease in the amount of pulses within the same time interval, say 30 or 25 pulses, is an indication or warning that cleaning is soon necessary. The information about flow rate, e.g. in terms of the number of pulses within said time interval, is registered and monitored locally, i.e. as part of a control system of the electronic pouring device itself, and triggers the sending of a cleaning message to the electronic pouring device, suitably with an intermittent message indicating "cleaning" on the visual display—this provided that the liquid indicator indicates that there is liquid in the electronic pouring device. At the same time, the valve member of the pouring device is displaced into a closed position. The bartender becomes then aware of the need to soon clean the device and proceed accordingly.

In an embodiment, said electronic pouring device further comprises a bottle gasket for tight insertion into said liquid container, i.e. bottle. The bottle gasket is preferably made of soft plastic. The bottle gasket is ideally conical and enables a tight fit with different sizes of bottle openings, so that alcohol from the liquor or wine does not dissipate away and oxygen from the air does not contact the liquor or wine.

The electronic device may also be provided with external arms, which engage with the outer part of a bottle neck to arrest the pouring device into a fixed position using sealing ties or tape or other.

In an embodiment, said electronic pouring device further comprises an air admission valve for allowing air entry into the liquid container. When said valve member is in the opened position, said air admission valve, i.e. air check valve, ensures that the pressure is unchanged in the bottle. During pouring, the air admission valve allows air to enter the bottle and at the same time avoids the leaking of liquid from the air admission valve. An improved pouring is thereby obtained.

In an embodiment, said electronic pouring device further comprises a bottle change detector. This enables registering when the electronic pouring device is placed on a bottle or removed from a bottle.

BRIEF DESCRIPTION OF THE DRAWINGS

The invention will now be further described by reference to the drawings.

FIG. 5 lower-part is a top view along cut A-A and shows details of the optical sensors used for controlling the displacement of the valve into an opened or closed position.

FIG. 1 shows the electronic pouring device 10 including housing 11, visual display e.g. in the form of screen 12 on an exterior surface 13 of said housing 11 and touching means 14 in the form of buttons for providing the desired dosage on the visual display 12. The dosage may be 20, 30 ml or any other size and is displayed on screen 12, preferably together with the name of the liquid, for instance "Vodka 25 ml". The electronic pouring device 10 is also provided with external arms 15, which engage with outer part of the bottle neck (not shown) to arrest the pouring device into a fixed position when using sealing ties or tape (not shown), as well as bottle gasket 16 for tight insertion into the bottle neck. The electronic pouring device includes also an inlet opening 17 for the passage of liquid from the liquid container (bottle). The flow of liquid passes through the inlet opening 17 as depicted by the arrow and exits at outlet orifice 18 as also depicted by the corresponding arrow and is thereby poured into a beverage glass or cocktail shaker or other recipient. The outlet orifice 18 is in direct fluid communication with an outlet opening 19 for the passage of liquid as it will become apparent in connection with the description of FIG. 2. An air check valve 37 is provided, which sucks air into the bottle during pouring. The electronic pouring device defines also a length direction extending vertically in the figure from bottom to top or top to bottom.

FIG. 2 shows the electronic pouring device 10 with housing 11 and interior parts including outlet opening 19 for the passage of liquid from the liquid container (bottle), valve seat 20 for arresting the valve member 22 and thereby the valve into a closed position. The valve member 22 controls the passage of the liquid. The valve comprises, valve outlet gasket 21, valve member 22, and valve rod 23. The valve member 22 is shown in the opened position. The valve rod 23 is adapted to cooperate with the valve member 22, which then causes the outlet gasket 21 to move towards the valve seat 20, thereby closing the valve member and thereby the valve (FIG. 3 shows such closed position of the valve member). Displacement means comprising transmission means in the form of e.g. a threaded rod 24 includes set of gears 26' 26". The threaded rod 24 is connected to second set of gears 26" and drive means in the form of e.g. electrical motor 25 connected to first set of gears 26' cause the displacement of the valve member away from the valve seat 20 into an opened position, so that liquid passes through the outlet opening 19 and then to outlet orifice 18 as described in connection with FIG. 1. The electrical motor 25 engages with first set of gears 26', which then engages with second set of gears 26" connected to the threaded rod 24, thus converting rotational motion into a linear motion of the valve rod 23 along the length direction of the electronic pouring device. Behind the electrical motor 25, the outer periphery of mill wheel e.g. casing 27 for the measurement of liquid flow is shown. Further, the housing 11 comprises a liquid internal region 28 for allowing the passage of said liquid. A membrane 29 separates the liquid internal region 28 from the dry internal region 30 (see FIG. 4) within the housing 11.

FIG. 3 is similar to FIG. 2, but with the valve member being in a closed position. The same reference numerals as for the previous figures apply. In addition, a protrusion 35' at lower end of valve rod 23 is shown. The protrusion 35' extends perpendicularly to the length direction of the valve rod 23 and in a direction pointing towards the transmission means. A nut 36 is integrated or embedded in this protrusion, i.e. affixed to protrusion 35' and thereby to valve rod 23, for securing the engagement with the transmission means 24. Furthermore, the membrane 29 has moved with respect to the opened position of FIGS. 2 and 3, as shown in the drawing, thus showing more clearly the separation of liquid internal region 28 from dry internal region 30. Thereby, the use of rigid steel plates, plastic, packing or the like for separating these liquid and dry internal regions is avoided while at the same time providing a more simple separation between the liquid internal region 28 and the dry internal region 30. The dry internal region 30 permits therefore the presence of electronic elements such as optical sensors 31' 31" for identification of the exact position of the valve rod 23 during its displacement as well as displacement means 24 25.

FIG. 4 shows the device for measuring the flow of liquid, which passes inside the liquid internal region. A flow of liquid from the bottle at the bottom of the figure as represented by the arrow enters the electronic pouring device via inlet opening 17. The liquid travels inside along the length direction of the electronic pouring device and comes into contact with internal arms 33 of mill wheel 27" (not shown) which is encapsulated by casing 27', so that the liquid remains inside and continues its travel towards outlet opening 19. The internal arms 33, i.e. rotating internal arms, extend radially from the centre of the mill wheel. Further, the internal arms 33 are provided with a magnet 39 adapted to cooperate with a sensor for detecting rotation 32. This sensor 32 is located in the dry internal region and suitably affixed to the outer part of casing 27', i.e. the surface of the casing 27' facing the dry internal region. By having six internal arms 33 in the mill wheel 27", each arm 33 being provided with a magnet, not only a highly precise and accurate measurement of the flow is possible, but also it is possible to register even a small amount of liquid passing through the pouring device, since a relatively high number of magnets, here six magnets, are provided along the periphery of the mill wheel. Sensor 32 detects the passage of each magnet and thereby enables an accurate and consistent measurement of the flow of liquid within a very confined space. Also shown in FIG. 4 is a bottle change detector 34 for registering when the electronic pouring device is placed on a bottle or removed from a bottle.

FIG. 5 shows a detail view of a set of optical sensors 31' 31" arranged in a first dry internal region 30 of the housing 11. Valve rod 23 is provided at its lower end with protrusion 35", which cooperates with the set of optical sensors 31' 31" for identification of the exact position of valve rod 23 during its displacement. As shown, the protrusion 35" extends perpendicularly with respect to the length direction of the valve rod 23. Protrusion 35" extends also in a direction away from the displacement means 24, 25. As the protrusion 35" passes in between the transmitting part and the receiving part of the set of optical sensors 31' 31", a light beam generated is interrupted and the displacement of the valve rod 23 and thereby the valve member is registered, so that its opening and closing is precisely controlled.

FIG. 6 shows a view of the drive means in form of electrical motor 25 and transmission means in the form of fourth set of gears with the mechanical stop for the valve member in an opened and closed position. Fixed on top of the electrical motor 25 is the small gear, e.g. nine teeth, i.e. first set of gears 26', driving the second set of gears 26" in form of a first larger gear 26"-I, e.g. having thirty-six teeth, which is connected to the threaded rod 24. The second set of gears includes a smaller gear 26"-II in the center, e.g. having nine teeth. This smaller gear 26"-II of the second set of gears drives a third set of gears 26'" which contains two sprockets, a first gear 26'"-I of the third set e.g. having thirty-six, driven by the gear 26"-II, and a second gear 26'"-II of the third set in the form center gear e.g. having nine teeth, which then drives the first gear 26""-I of fourth gear set, having e.g. thirty-six teeth, and further provided with a stop block 40 mounted on the top. When the valve member gets to full open position, one end of the stop block 40' at the fourth gear 26"" hits a corresponding end of stopping element 41' mounted on the housing of the electronic pouring device. When the valve member moves to a closed position, the opposite side of the stop block 40" on the fourth gear 26"" will hit the opposite side or end of the stopping element 41", once the valve member has the correct closing position.

DETAILED DESCRIPTION

List of Parts

Figure 1:
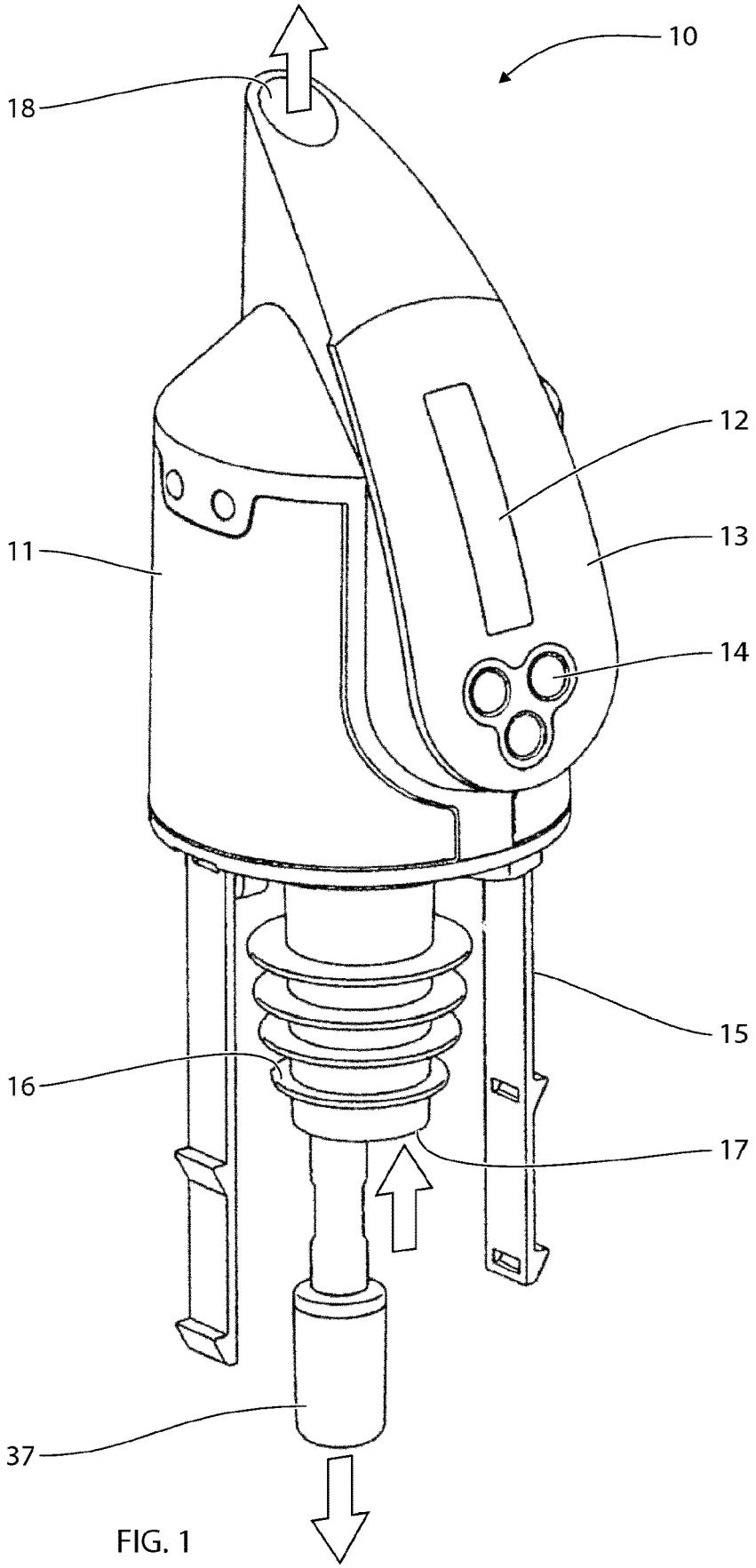
FIG. 1 shows a perspective of the electronic pouring device.
Figure 2:
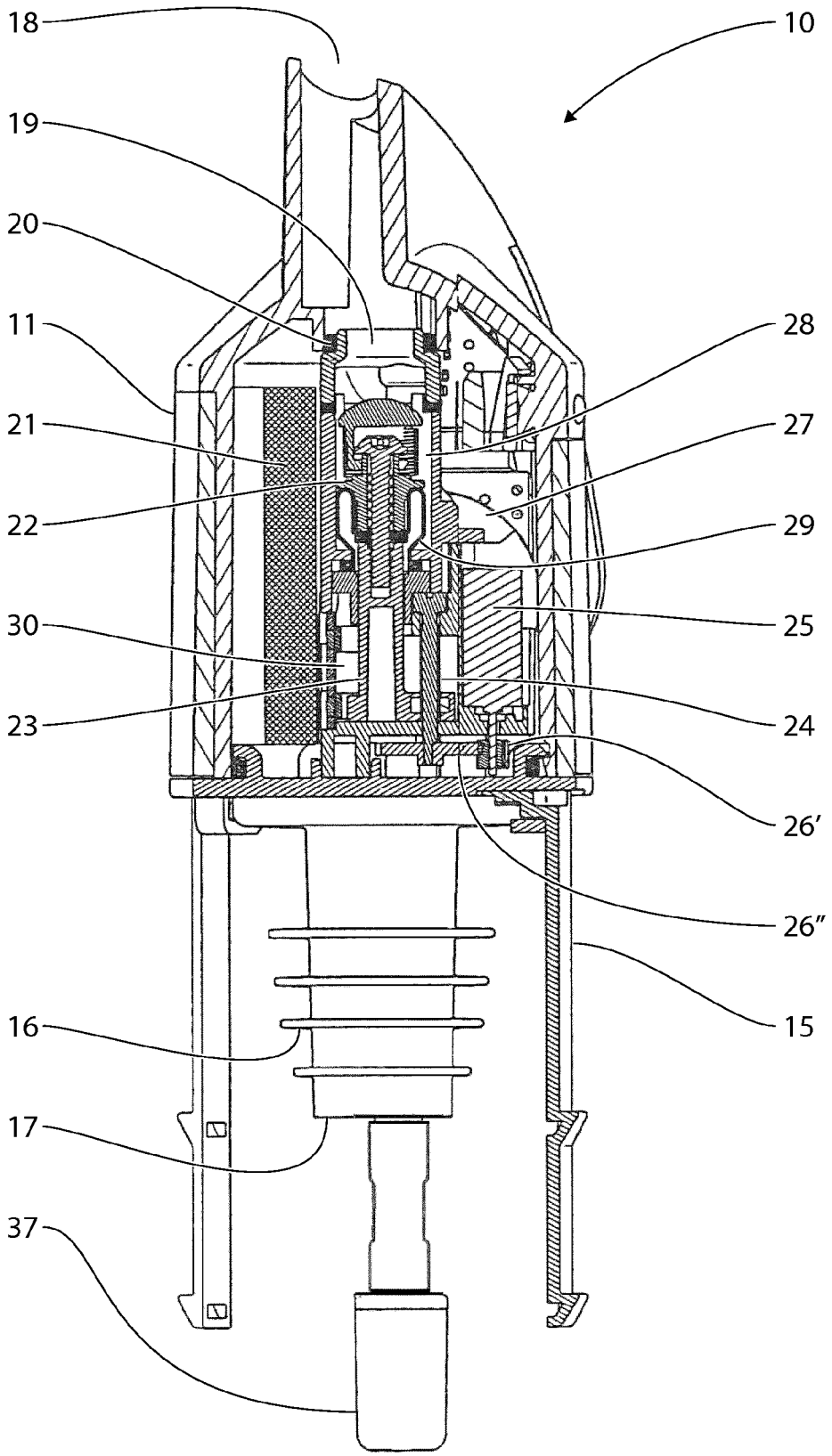
FIG. 2 shows a cut-out front view of the electronic pouring device with the housing and its interior parts including displacement means and valve member for controlling the passage of liquid in an opened position.
Figure 3:
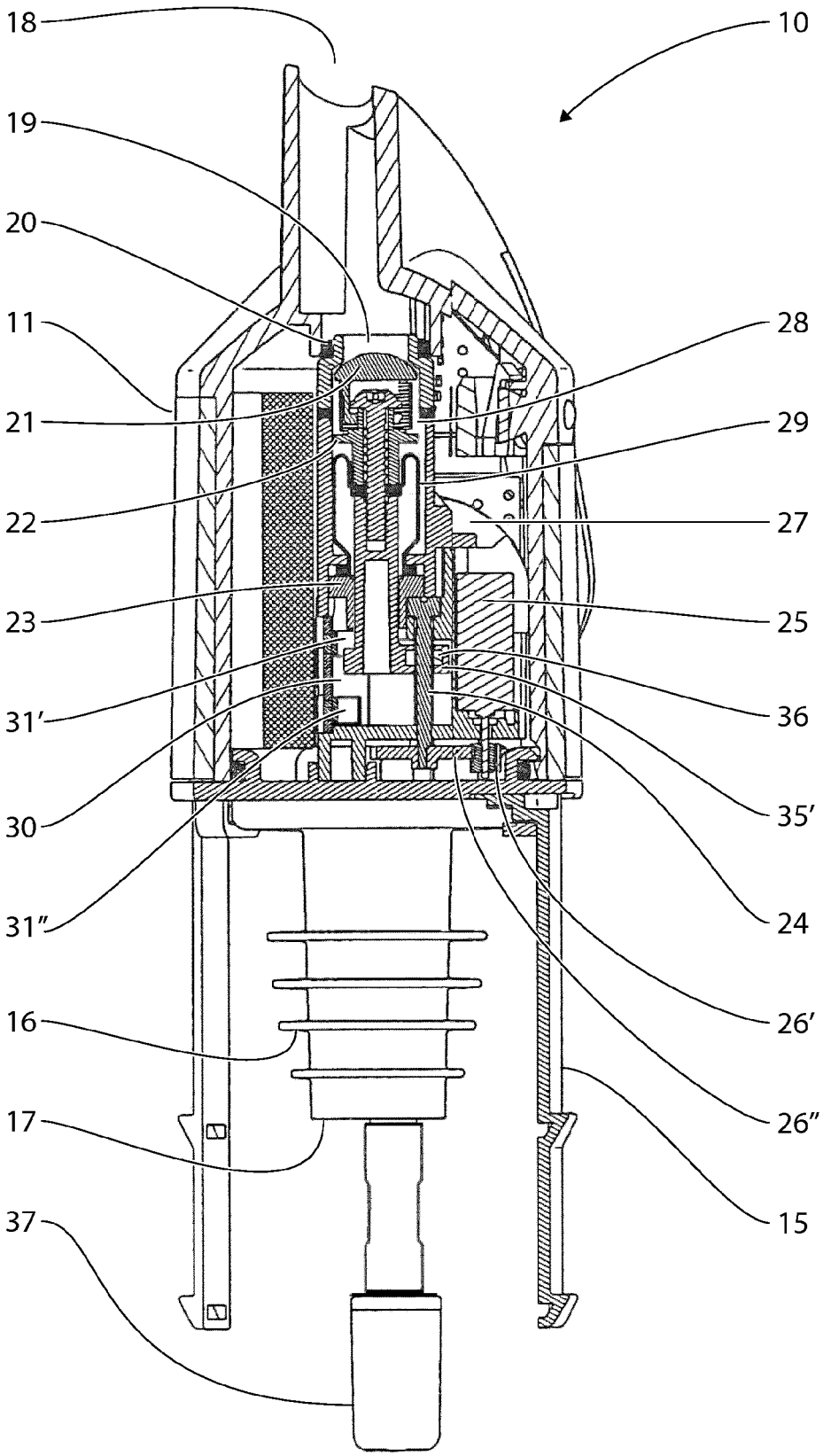
FIG. 3 shows a front view as in FIG. 2, yet with the valve member in a closed position.
Figure 4:
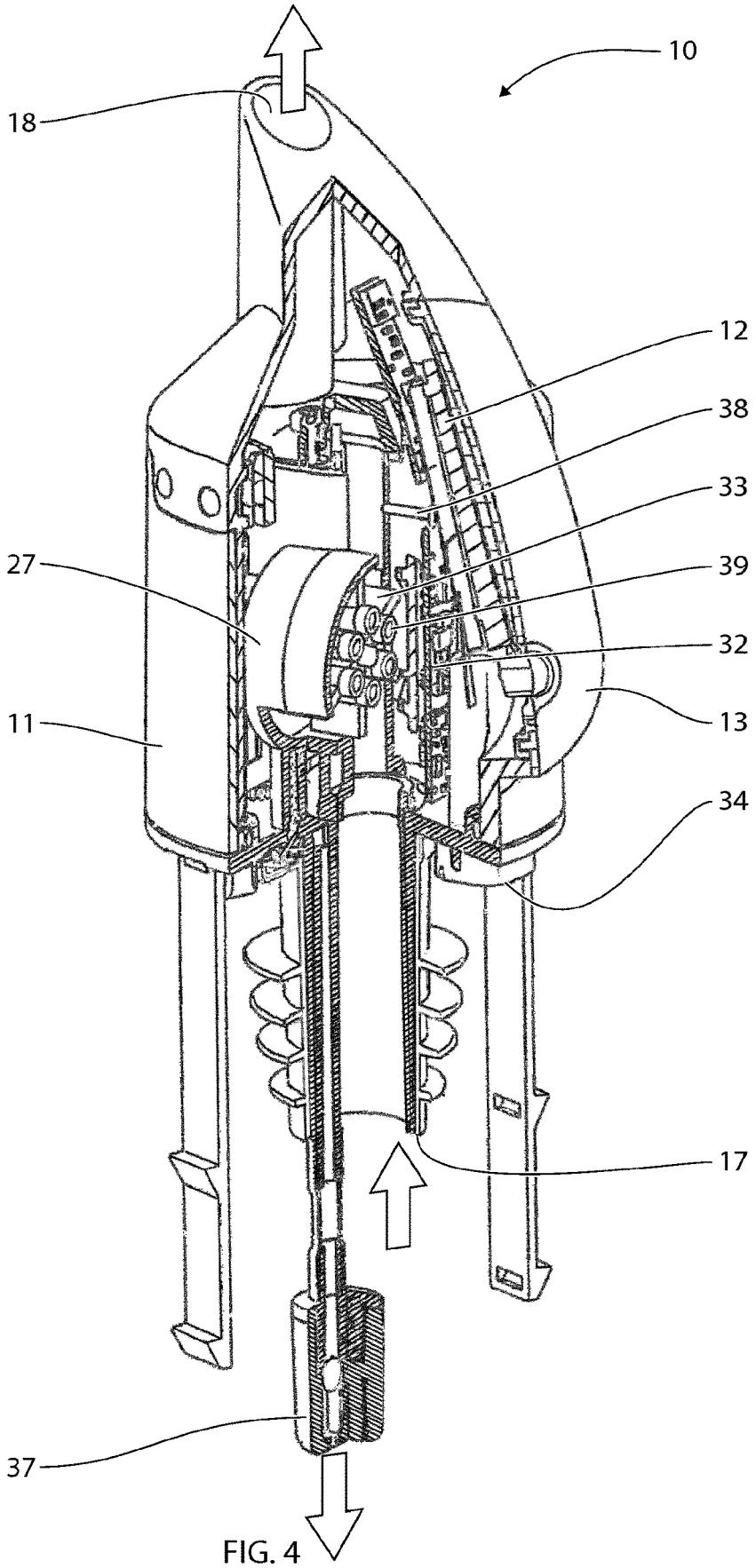
FIG. 4 shows a perspective of an internal part of the electronic pouring device including the device for measuring the flow of liquid.
Figure 5:
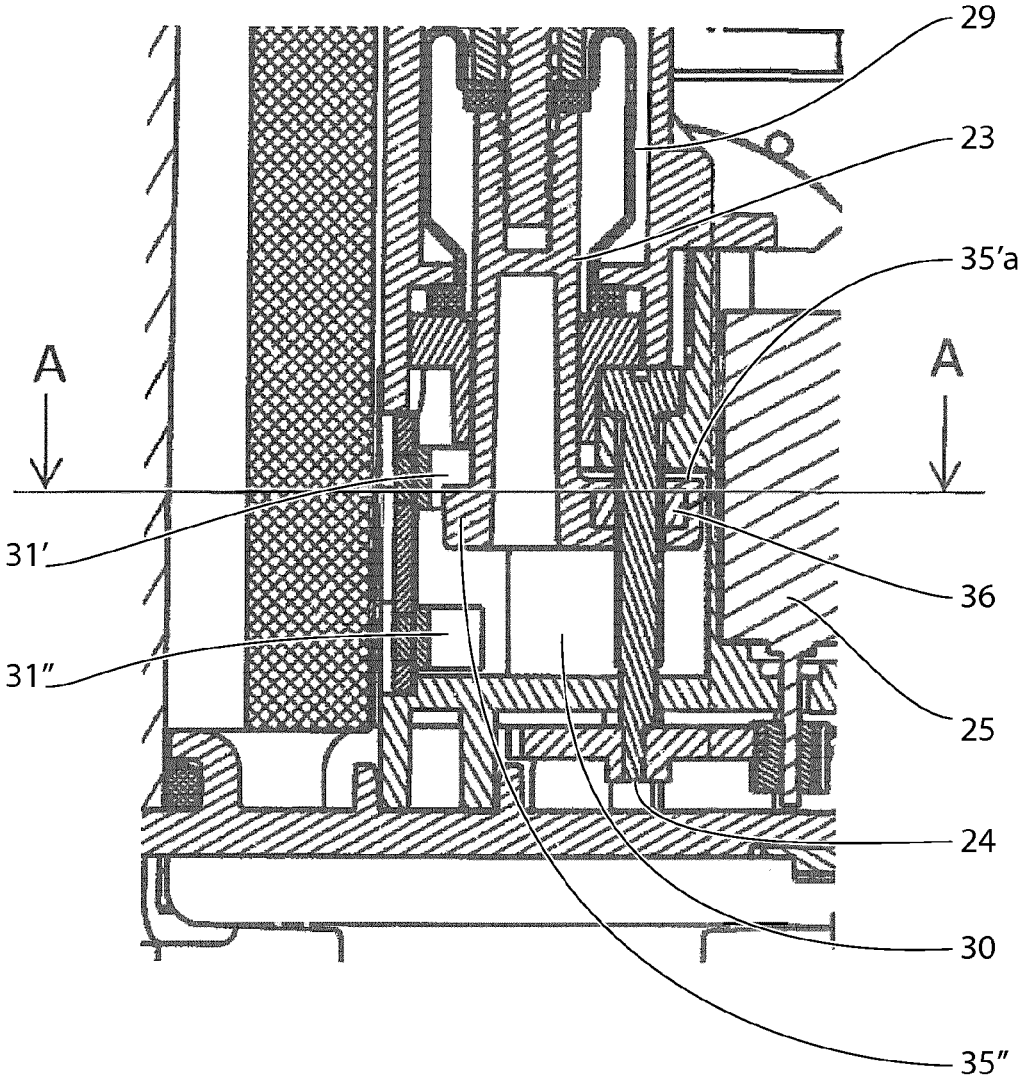
FIG. 5 upper-part is an expanded and detailed view of the area depicted in FIG. 3.
Figure 5:
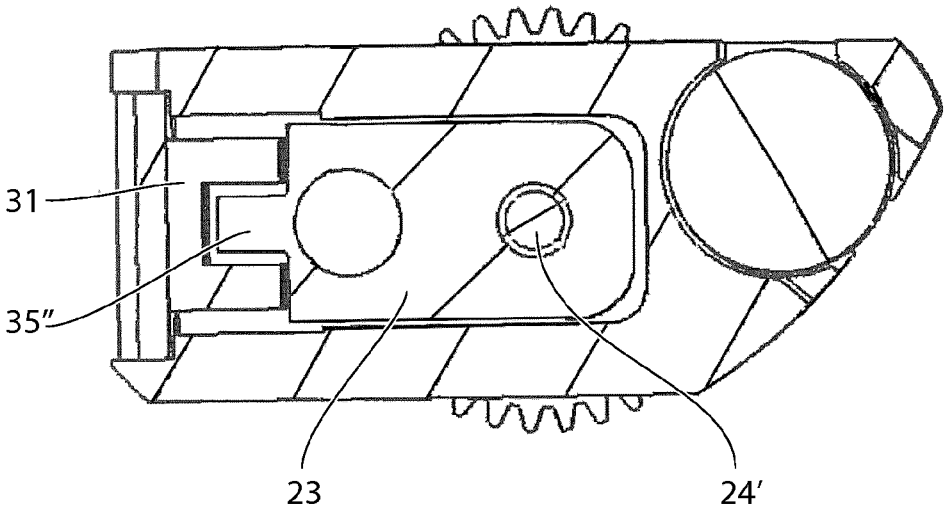
Figure 6:
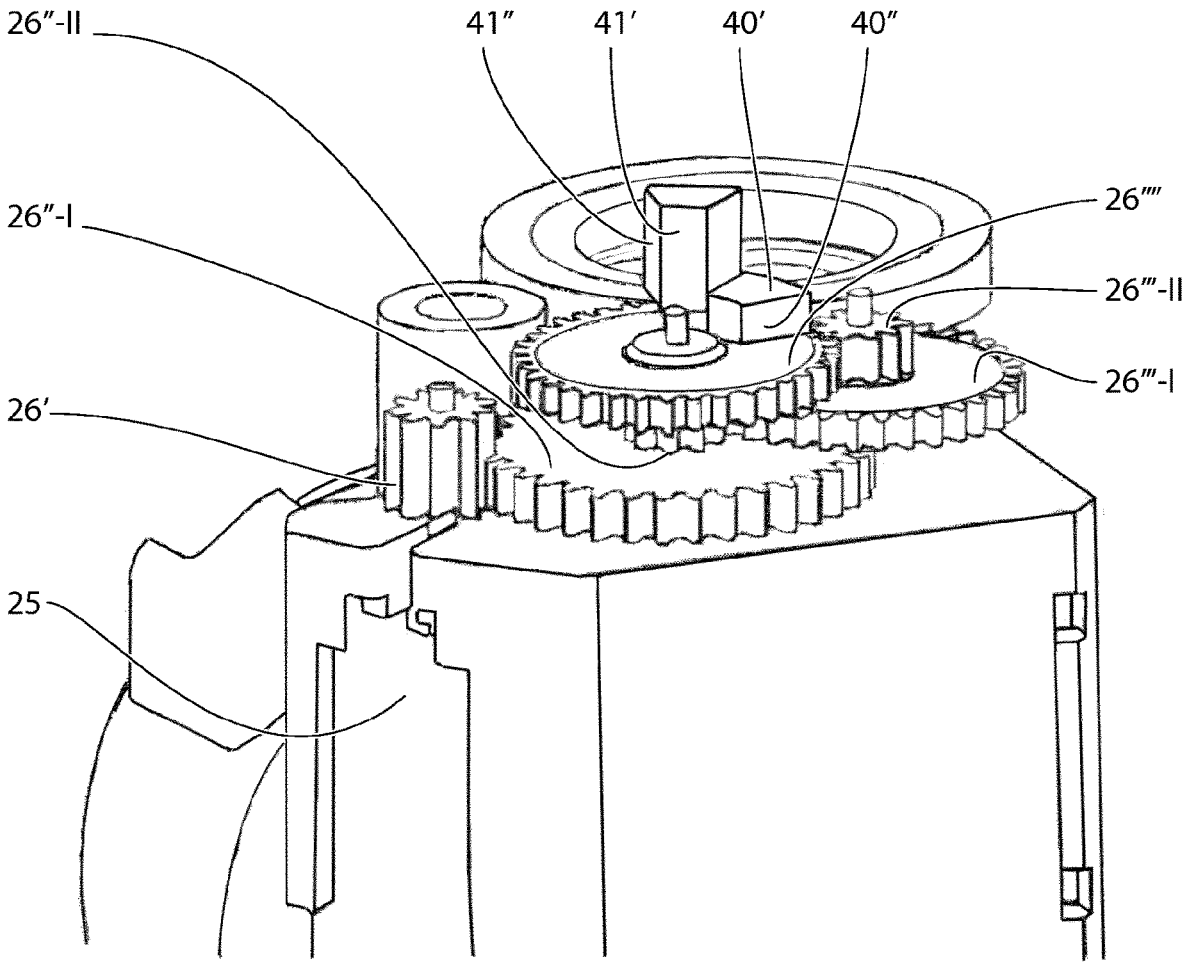
FIG. 6 is a perspective view of an alternative embodiment comprising four sets of gears for controlling the displacement of the valve into an opened or closed position.

10. Electronic pouring device
11. Housing
12. Visual display; screen
13. Exterior surface of housing
14. Dosage buttons
15. External arms
16. Bottle gasket
17. Inlet opening
18. Outlet orifice
19. Outlet opening
20. Valve seat
21. Outlet gasket
22. Valve member
23. Valve rod including nut
24. Transmission means; threaded rod
25. Drive means; electrical motor
26. Set of gears; $1^{st}$-$4^{th}$ set of gears
27. Casing; mill wheel
28. Liquid internal region
29. Membrane
30. Dry internal region
31. Set of optical sensors
32. Sensor for detecting rotation
33. Internal arm of mill wheel
34. Bottle change sensor
35. Protrusion at lower end of valve rod 23
36. Nut
37. Air admission valve; air check valve
38. Liquid detector
39. Magnets
40. Stop block
41. Stopping element It should further be noted that a prim (') or prims (") symbols in the description and in the figures denote alternative realizations of the same part.

The invention is characterised by the following points:

1. Electronic pouring device for dosing a pre-determined amount of liquid from a liquid container, said electronic pouring device comprising a housing, said housing comprising:
   - an inlet opening and an outlet opening for the passage of liquid from said liquid container,
   - a valve comprising a valve member for controlling the passage of said liquid and a valve seat at said outlet opening for arresting said valve member in a closed position,
   - a liquid internal region for accommodating said valve member and for allowing the passage of said liquid through said housing,
   - a dry internal region for accommodating displacement means for displacing said valve member against said valve seat into said closed position, or for displacing said valve member away from said valve seat into an opened position, said displacement means comprising drive means and transmission means,
   - a membrane for separating said dry internal region from said liquid internal region.

2. Electronic pouring device according to point 1, wherein said valve further comprises a valve outlet gasket, and a valve rod, said valve member adapted to cooperate with said valve outlet gasket, said valve rod adapted to cooperate with said valve member, and wherein said displacement means for displacing said valve member actuates on said valve rod, said valve rod thereby displacing said valve member and said valve outlet gasket, thereby also displacing said valve member into said opened or closed position.

3. Electronic pouring device according to any preceding point, wherein said membrane cooperates with said valve rod, whereby said valve rod actuates on said membrane by moving the membrane as the valve rod displaces said valve member into said closed position or said opened position.

4. Electronic pouring device according to any preceding point, wherein the drive means includes at least one motor, and the transmission means includes at least one threaded rod.

5. Electronic pouring device according to point 4, wherein the transmission means also includes a set of gears comprising a first and a second set of gears, where said threaded rod is connected to said second set of gears, while the motor engages with said first set of gears, and said first set of gears engages with said second set of gears and thereby said threaded rod.

6. Electronic pouring device according to any preceding point, wherein said dry internal region includes:

(a) a set of sensors for identification of the exact position of said valve member or said valve rod during its displacement, and/or (b) a mechanical stopping mechanism provided on said transmission means for identification of the exact position of said valve member or said valve rod during its displacement.

7. Electronic pouring device according to point 6, wherein in (a) said set of sensors is a set of optical sensors, said valve rod is provided with a protrusion at its lower end extending perpendicularly to the length direction of the valve rod, and said set of optical sensors is adapted to cooperate with said protrusion for controlling the displacement of said valve member into said opened or closed position, and/or wherein in (b) the transmission means includes a third and fourth set of gears, wherein a second and preferably smaller gear, e.g. having nine teeth, of said second set of gears is adapted on top of said first of gear, e.g. having thirty-six teeth, of said second set of gears, wherein said second and smaller gear of the second set of gears drives a third set of gears by engaging with a first and preferably larger gear, e.g. having thirty-six teeth of said third set of gears, wherein a second and preferably smaller gear, e.g. having nine teeth, of said third set of gears is adapted on top of said first gear, e.g. having thirty-six teeth, of said third set of gears, wherein said second and smaller gear of said third set of gears drives a fourth set of gears by engaging with a first and preferably larger gear, e.g. having thirty-six teeth, of said fourth set of gears, and wherein said first gear of said fourth set of gears is provided on its top with a stop block, and wherein said housing is provided with a stopping element seated or affixed thereto, which is adapted to cooperate with said stop block.

8. Electronic pouring device according to any of points 2-7, wherein said valve outlet gasket has a rounded shape, preferably in the form of a ball, which is adapted to tightly seal said outlet opening at said valve seat.

9. Electronic pouring device according to any preceding point, said housing further comprising, preferably within said liquid internal region, a device for measuring the flow of said liquid.

10. Electronic pouring device according to point 9, wherein said device for measuring the flow of liquid includes a mill wheel encapsulated by a casing, said casing having a surface facing said dry liquid internal region, said surface being adapted to cooperate with a sensor for detecting the rotation of said mill wheel as the liquid passes through, said mill wheel including one or more internal arms, said mill wheel defining a centre, said one or more internal arms extending radially from said centre, and said one or more internal arms being provided, preferably at either end, with a magnet adapted to cooperate with said sensor.

11. Electronic pouring device according to point 10, wherein the number of said rotating internal arms is 4-8, preferably 6, and said sensor is a hall-effect sensor.

12. Electronic pouring device according to any preceding point, said housing further comprising an inclination detector for registering the inclination of said electronic pouring device with respect to a vertical axis, said vertical axis being an axis extending along the direction of the gravity force.

13. Electronic pouring device according to points 9-12, wherein said device for measuring the flow of liquid and said inclination detector are adapted to cooperate with each other for determining when the pouring of said liquid is initiated, by activating said drive means and thereby displacing said valve member into said opened position.

14. Electronic pouring device according to any preceding point, further comprising within said dry internal region, a printed circuit board (PCB) containing electronic components including communication means for wireless communication with an external transmitter.

15. Electronic pouring device according to any preceding point, further comprising a visual display adapted on the exterior surface of said housing for at least indicating said liquid brand or type and/or said pre-determined amount of liquid.

16. Electronic pouring device according to any preceding point, further comprising an air admission valve for allowing air entry into the liquid container.

17. Electronic pouring device according to any preceding point, wherein said membrane is at least 10% larger, preferably at least 30% larger, more preferably at least 50% larger, than is necessary to accommodate the distance travelled by the displacement of said valve member from said closed position into said opened position, or the distance travelled by the displacement of said valve member from said opened position into said closed position.

18. Electronic pouring device according to any preceding point, wherein said membrane includes an outer ring, which is liquid-tight and disposed between said dry internal region and said liquid internal region, and an inner ring, which is liquid-tight and attached to said valve member and said valve rod, whereby said moving of said membrane is conducted by said valve rod moving said inner ring, as said valve rod displaces said valve member into said closed position and said opened position.

19. Electronic pouring device according to any preceding point, further comprising a liquid detector for registering the presence of liquid, including the flow of liquid, in said liquid internal region, i.e. liquid chamber.

20. Electronic pouring device according to any preceding point, further comprising a bottle gasket for tight insertion into said liquid container.

The invention claimed is:

1. Electronic pouring device for dosing a pre-determined amount of liquid from a liquid container, said electronic pouring device comprising a housing, said housing comprising:

an inlet opening and an outlet opening for the passage of liquid from said liquid container, a valve comprising a valve member for controlling the passage of said liquid and a valve seat at said outlet opening for arresting said valve member in a closed position, wherein said valve further comprises a valve outlet gasket and a valve rod, said valve member adapted to cooperate with said valve outlet gasket, said valve rod adapted to cooperate with said valve member, a liquid internal region for accommodating said valve member and for allowing the passage of said liquid through said housing, a dry internal region for accommodating displacement means for displacing said valve member against said valve seat into said closed position, or for displacing said valve member away from said valve seat into an opened position, said displacement means comprising drive means and transmission means, wherein said displacement means for displacing said valve member actuates on said valve rod, said valve rod thereby displacing said valve member and said valve outlet gasket, thereby also displacing said valve member into said opened or closed position, a membrane for separating said dry internal region from said liquid internal region.

2. Electronic pouring device according to claim 1, wherein said membrane cooperates with said valve rod, whereby said valve rod actuates on said membrane by moving the membrane as the valve rod displaces said valve member into said closed position or said opened position.

3. Electronic pouring device according to claim 1, wherein the drive means includes at least one motor, and the transmission means includes at least one threaded rod.

4. Electronic pouring device according to claim 3, wherein the transmission means also includes a set of gears comprising a first and a second set of gears, where said threaded rod is connected to said second set of gears, while the motor engages with said first set of gears, and said first set of gears engages with said second set of gears and thereby said threaded rod.

5. Electronic pouring device according to claim 4, wherein said dry internal region includes:

(a) a set of sensors for identification of an exact position of said valve member or said valve rod during displacement, and/or (b) a mechanical stopping mechanism provided on said transmission means for identification of the exact position of said valve member or said valve rod during displacement.

6. Electronic pouring device according to claim 5, wherein in (a) said set of sensors is a set of optical sensors, said valve rod is provided with a protrusion at a lower end extending perpendicularly to a length direction of the valve rod, and said set of optical sensors is adapted to cooperate with said protrusion for controlling the displacement of said valve member into said opened or closed position, and/or wherein in (b) the transmission means includes a third and fourth set of gears, wherein a second gear of said second set of gears is adapted on top of a first gear of said second set of gears, wherein said second gear of the second set of gears drives a third set of gears by engaging with a first gear of said third set of gears, wherein a second gear of said third set of gears is adapted on top of a first gear of said third set of gears, wherein said second gear of said third set of gears drives a fourth set of gears by engaging with a first gear of said fourth set of gears, and wherein said first gear of said fourth set of gears is provided on a top with a stop block, and wherein said housing is provided with a stopping element seated or affixed thereto, which is adapted to cooperate with said stop block.

7. Electronic pouring device according to claim 1, wherein said valve outlet gasket has a rounded shape which is adapted to tightly seal said outlet opening at said valve seat.

8. Electronic pouring device according to claim 1, said housing further comprising a device for measuring the flow of said liquid.

9. Electronic pouring device according to claim 8, wherein said device for measuring the flow of liquid includes a mill wheel encapsulated by a casing, said casing having a surface facing said dry liquid internal region, said surface being adapted to cooperate with a sensor for detecting the rotation of said mill wheel as the liquid passes through, said mill wheel including one or more internal arms, said mill wheel defining a centre, said one or more internal arms extending radially from said centre, and said one or more internal arms being provided with a magnet adapted to cooperate with said sensor.

10. Electronic pouring device according to claim 9, wherein the number of said rotating internal arms is 4-8 and said sensor is a hall-effect sensor.

11. Electronic pouring device according to claim 1, said housing further comprising an inclination detector for registering the inclination of said electronic pouring device with respect to a vertical axis, said vertical axis being an axis extending along the direction of the gravity force.

12. Electronic pouring device according to claim 8, wherein said device for measuring the flow of liquid and said inclination detector are adapted to cooperate with each other for determining when the pouring of said liquid is initiated, by activating said drive means and thereby displacing said valve member into said opened position.

13. Electronic pouring device according to claim 1, further comprising within said dry internal region, a printed circuit board (PCB) containing electronic components including communication means for wireless communication with an external transmitter.

14. Electronic pouring device according to claim 1, further comprising a visual display adapted on the exterior surface of said housing for at least indicating said liquid brand and/or said pre-determined amount of liquid.

* * * * *